US009844122B1

(12) United States Patent
Chan

(10) Patent No.: US 9,844,122 B1
(45) Date of Patent: Dec. 12, 2017

(54) METHODS AND SYSTEMS FOR SEMI-AUTONOMOUS LIGHTING CONTROL

(71) Applicant: Kai Man Chan, Hong Kong (HK)

(72) Inventor: Kai Man Chan, Hong Kong (HK)

( * ) Notice: Subject to any disclaimer, the term of this patent is extended or adjusted under 35 U.S.C. 154(b) by 0 days.

(21) Appl. No.: 15/406,708

(22) Filed: Jan. 14, 2017

(51) Int. Cl.
*H05B 37/02* (2006.01)

(52) U.S. Cl.
CPC ..... *H05B 37/0281* (2013.01); *H05B 37/0209* (2013.01)

(58) Field of Classification Search
None
See application file for complete search history.

(56) References Cited

U.S. PATENT DOCUMENTS

2016/0066393 A1* 3/2016 Bosua ..... H05B 33/0863 315/307

* cited by examiner

*Primary Examiner* — Jany Richardson

(57) ABSTRACT

Systems and methods are provided for semi-automatic light control systems which support, amongst other features, receiving a light controlling values from one or more users and choosing an optimal light value based on the aggregated preferences of the present users. The lighting elements of the lighting system are further adjusted based on user perception profiles and other parameters. A semi-automatic determination may be made of a second light controlling value based on the first light controlling value and a user perception profile relating light parameter values with perceived light output values. Lighting element operation may be incrementally adjusted to meet the second light parameter value over a predetermined time period.

8 Claims, 7 Drawing Sheets

METHODS AND SYSTEMS FOR SEMI-AUTONOMOUS LIGHTING CONTROL

FIELD OF THE INVENTION

The presently disclosed technology generally relates to lighting systems, and more specifically to methods for controlling lighting system parameters based on received parameters.

BACKGROUND OF THE DISCLOSED TECHNOLOGY

Lighting systems have been around for over one hundred years. Advancements in technology have facilitated widespread installation of lighting systems in even the remotest of places. Moreover, LED technology has made operation of lighting systems a lot more affordable. Similarly, lighting systems have become vastly more complicated and their reach is ever expanding.

The use of a light system which adequately brightens all areas of a given grounds, depending on the use thereof, may be necessary in establishments such as business buildings. Therefore, areas to be stressed or which are considered to have a greater number of visitors are usually lit with greater intensity. The light conditions in these environments cover the entire working surroundings, with a greater emphasis on those places where products or services are offered and for the purpose of guiding people through specific paths. Therefore, the most common purpose of lighting systems is to favor the use of outside or interior spaces, improving the user's experience of said spaces and emphasizing the usefulness of the services offered therein.

However, until now, most lighting systems installed on the grounds or premises surrounding different businesses and residences are indiscriminate in their lighting capacities. That is, areas which receive greater use or a greater amount of traffic are generally lit using the same settings as those areas which receive very little traffic. These settings, may be, for example, set on dusk to dawn cycle, or a timed cycle (e.g, between 18:00 and 24:00 hours). Nevertheless, whichever settings are used, they are applied to the entire lighting system or cluster of lights. depending on the installation arrangement.

Accordingly, there is a demand for a light device which allows obtaining sensing evidence in an integral manner, taking advantage of the strategic location thereof, which allows understanding the fundamental factors making up the experience at the places where point of sale occur, and which provides mechanisms for managing the lighting of an environment, such as a business building, depending on where the actual electronically-obtained data is received.

SUMMARY OF THE INVENTION

According to embodiments of the disclosed technology, systems and methods are provided for semi-automatic light control systems which support, amongst other features, receiving a light controlling values from one or more users and choosing an optimal light value based on the aggregated preferences of the present users. The lighting elements of the lighting system are further adjusted based on user perception profiles and other parameters. A semi-automatic determination may be made of a second light controlling value based on the first light controlling value and a user perception profile relating light parameter values with perceived light output values. Lighting element operation may be incrementally adjusted to meet the second light parameter value over a predetermined time period.

Referring now to specific embodiments of the disclosed technology, a method is provided for semi-automatic lighting system control, the lighting system having at least a lighting element. The method be carried out, not necessarily in the following order, by: a) receiving a first light intensity value from a user account associated with an identifier for the lighting system; b) determining a first lightir g e ent control instruction based on the first light intensity value; c) controlling the lighting element according to the first lighting element control instruction; d) determining lighting system association with a power reduction mode; e) within a predetermined time period from first light intensity value receipt, semi-automatically determining a second light intensity value based on the lighting system mode and first light intensity value, the second light intensity value being lower than the first light intensity value; and f) incrementally adjusting lighting element operation to meet the second light parameter value over a second predetermined time period.

In embodiments, the second light intensity value may be selected based on a user perception profile, wherein the user perception profile relates light intensity values with perceived light output values, and further wherein the user perception profile may be associated with or use for the user account.

In a further embodiment, additional steps may be carried out by: a) receiving a third light intensity value from the user account, wherein the third light intensity value is between the first and second light intensity values; b) determining a third lighting element control instruction based on the third light intensity value; c) controlling the lighting element according to the third lighting element control instruction; and d) updating the user perception profile based on the third light intensity value. A second user perception profile may be used as an additional user perception profile to account for an optimized balance between preferences of all users semi-automatically. The aforementioned determination may be based on location of all the users. The lighting element operation may be incrementally adjusted in response to determination that a user device associated with the user account is located within a predetermined physical region. The second light parameter value may have a second light intensity value.

In still a further embodiment, additional steps may be carried out by: a) determining second user device location within the predetermined physical region, the second user device associated with a second user account; b) semi-automatically determining a third light intensity value based on the first light intensity value and a second user perception profile associated with the second user account; and c) operating the lighting system based on the second and third light intensity values, wherein the lighting system further employs a second lighting element, the first and second lighting elements mounted at a first and second radial position on the lighting system, wherein operating the lighting system based on the second and third light intensity values entails: incrementally adjusting the first lighting element operation to meet the second light intensity value over the predetermined time period and incrementally adjusting second lighting element operation to meet the third light intensity value over a second predetermined time period.

Still further, the lighting element may be initially set according to the first lighting element control instruction, and lighting element operation may be incrementally adjusted to meet the second light parameter value over a second predetermined time period.

Additional processes may be carried out by: a) determining a plurality of adjustment times the lighting element is initially set; b) determining an intermediary light intensity value for each adjustment time, wherein each intermediary light intensity value is between the first and second light intensity values; determining an intermediary lighting element control instruction for each intermediary light intensity value; and c) at each adjustment time, controlling the lighting element according to the respective lighting element control instruction, and wherein the first lighting element control instruction employs a first current magnitude corresponding to the first light intensity value, and the intermediary lighting element control instruction employs an intermediary current magnitude, different from the first current magnitude, corresponding to the intermediary light intensity value. The first light intensity value corresponds to a first perceived light output value. Determination of the second light intensity value based on the first light intensity value may be carried out by determining a second perceived light output value based on the first perceived light output value and selecting a light intensity value corresponding to the second perceived light output value as the second light intensity value, based on a user perception profile relating light intensity values with perceived light output values.

In still another embodiment of the disclosed technology, a method is provided for semi-automatic lighting system control. The method may be carried out, not necessarily in the following order, by: a) receiving a first light parameter value selection from a user account associated with the lighting system; b) controlling lighting elements of the lighting system to meet the first light parameter value; c) semi-automatically determining a second light parameter value based on the first light parameter value and a user perception profile relating light parameter values with perceived light output values; and d) incrementally adjusting lighting element operation to meet the second light parameter value over a predetermined time period.

The user perception profile may be operable to relate luminous flux with perceived luminous flux. The first light parameter value may have a first luminous flux value, and controlling the lighting elements to meet the first light parameter value may involve controlling the lighting elements to meet the first luminous flux value. The first luminous flux value corresponds to a first perceived luminous flux value, and determining the second light parameter value based on the first light parameter value may involve determining a second perceived luminous flux value based on the first perceived luminous flux value and selecting a second luminous flux value corresponding to the second perceived luminous flux value as the second light parameter value.

One or more additional steps may be carried out, not necessarily in the following order, by: a) determining a lighting system mode based on an identifier for the lighting system, wherein the second light parameter value is determined based on the lighting system mode, further wherein the lighting system mode employs a power reduction mode, wherein the first light parameter value has a first luminous flux value and the second light parameter value has a second luminous flux value lower than the first luminous flux value. b) controlling lighting elements to meet the first light intensity value by determining a current magnitude based on the first light parameter value; and c) supplying current at the current magnitude to the lighting elements, wherein lighting element operation is incrementally adjusted to meet the second light parameter value by incrementally lowering the magnitude of the current supplied to the lighting elements, the first parameter value having a first wavelength. The user perception profile may employ an equation. Determining a second light parameter value may involve calculating the second light parameter value as a predetermined percentage of the first light parameter value. The predetermined percentage is selected based on the first light parameter value.

In a further embodiment, the lighting elements are operated to meet the first light parameter value at a first time. Then, lighting element operation is incrementally adjusted to meet the second light parameter value over a predetermined time period by: a) determining a second time separated by the predetermined time period from the first time; b) determining a plurality of adjustment times between the first time and the second time; c) determining a plurality of intermediary light parameter values between the first light parameter value and the second light parameter value, each intermediary light parameter value associated with an adjustment time; and d) in response to occurrence of an adjustment time, controlling the lighting element to meet the respective intermediary light parameter value.

A better understanding of the disclosed technology will be obtained from the following brief description of drawings illustrating exemplary embodiments of the disclosed technology.

DETAILED DESCRIPTION OF EMBODIMENTS OF THE DISCLOSED TECHNOLOGY

References will now be made in detail to the present exemplary embodiments, examples of which are illustrated in the accompanying drawings. Certain examples are shown in the above-identified figures and described in detail below. In describing these examples, like or identical reference numbers are used to identify common or similar elements. The figures are not necessarily to scale and certain features and certain views of the figures may be shown exaggerated in scale or in schematic for clarity and/or conciseness.

The presently disclosed technology is directed to systems and methods for semi-automatic light control systems which support, amongst other features, receiving a light controlling values from one or more users and choosing an optimal light value based on the aggregated preferences of the present users. The lighting elements of the lighting system are further adjusted based on user perception profiles and other parameters. A semi-automatic determination may be made of a second light controlling value based on the first light controlling value and a user perception profile relating light parameter values with perceived light output values. Lighting element operation may be incrementally adjusted to meet the second light parameter value over a predetermined time period.

Figure 1:
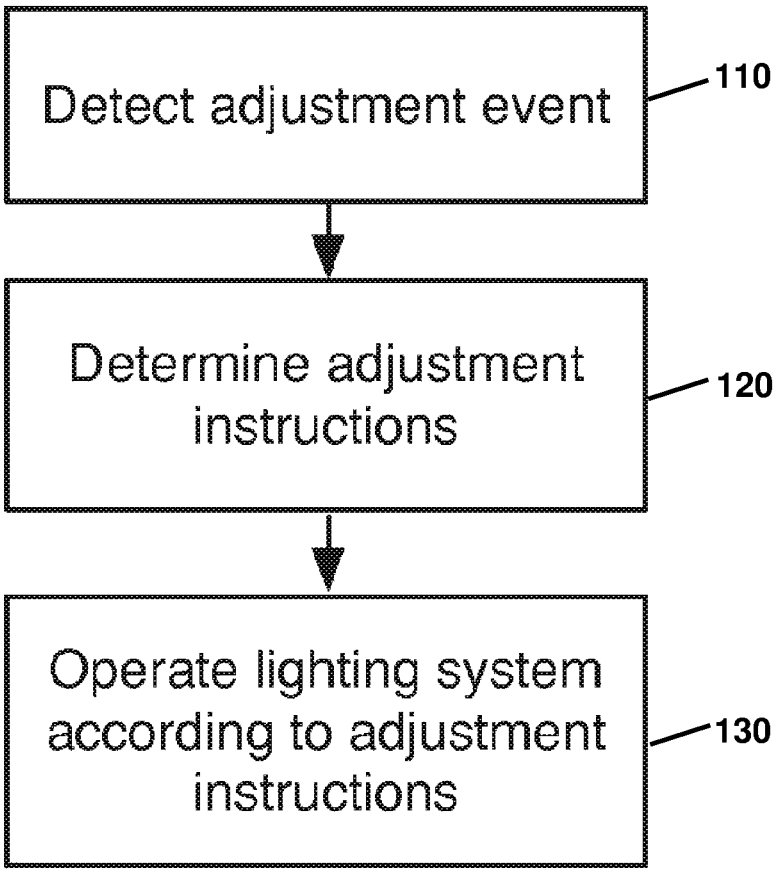
FIG. 1 shows a flow chart overview generalizing operation of the lighting system according to embodiments of the disclosed technology.

Referring now to the drawings, FIG. 1 shows a flow chart overview generalizing operation of the lighting system according to embodiments of the disclosed technology. In the first step, Step 110, an adjustment event is detected. Such an event may refer to received data regarding the lighting element. Such data may be, for example, a light intensity value from a user account associated with an identifier for the lighting system. Next, in Step 120, adjustment instructions are determined based on the detected adjustment event. This step may involve determining a lighting element control instruction based on the received light intensity value. In Step 130, the lighting system is operated according to the adjustment instructions. This step may be carried out by: i) controlling the lighting element according to the lighting element control instruction; ii) determining lighting system association with a power eduction mode; iii) within a predetermined time period from light intensity value receipt, semi-automatically determining another light intensity value based on the lighting system mode and first light intensity value, the second light intensity value being lower than the first light intensity value; and/or iv) incrementally adjusting lighting element operation to meet the second light parameter value over a predetermined time period. The second light intensity value may be selected based on a user perception profile, wherein the user perception profile relates light intensity values with perceived light output values, and further wherein the user perception profile is for the user account.

Figure 2:
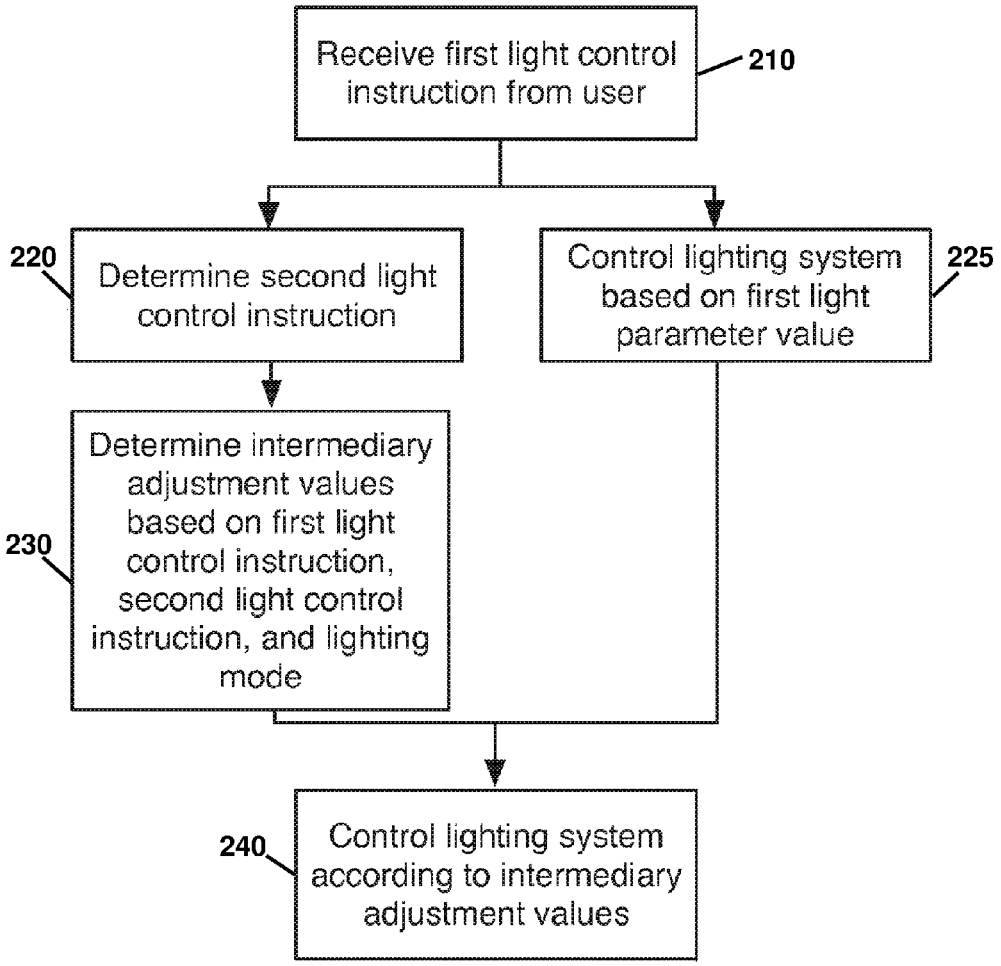
FIG. 2 shows a flow chart outlining operational steps with respect to multiple light control instructions according to embodiments of the disclosed technology.

FIG. 2 shows a flow chart outlining operational steps with respect to multiple light control instructions according to embodiments of the disclosed technology. In Step 210, a first light intensity value is received from a user account associated with an identifier for the lighting system. Step 220 is carried out by determining a first lighting element control instruction based on the first light intensity value. Step 225 proceeds by controlling the lighting element according to the first lighting element control instruction. In Step 230, intermediary adjustment values are determined based on first light control instruction (Step 210), second light control instruction (Step 220) and lighting mode. Step 225 may be performed contemporaneously with Steps 220 and 230. Next, in Step 240, the lighting system is controlled according to intermediary adjustment values.

In a further embodiment, additional steps may be carried out of: a) receiving a third light intensity value from the user account, wherein the third light intensity value is between the first and second light intensity values; b) determining a third lighting element control instruction based on the third light intensity value; c) controlling the lighting element according to the third lighting element control instruction; and d) updating the user perception profile based on the third light intensity value. A second user perception profile may be used as an additional user perception profile to account for an optimized balance between preferences of all users semi-automatically. The aforementioned determination may be based on location of all the users. The lighting element operation may be incrementally adjusted in response to determination that a user device associated with the user account is located within a predetermined physical region. The second light parameter value may have a second light intensity value.

In still a further embodiment, additional steps may be carried out by: a) determining second user device location within the predetermined physical region, the second user device associated with a second user account; b) semi-automatically determining a third light intensity value based on the first light intensity value and a second user perception profile associated with the second user account; and c) operating the lighting system based on the second and third light intensity values, wherein the lighting system further employs a second lighting element, the first and second lighting elements mounted at a first and second radial position on the lighting system, wherein operating the lighting system based on the second and third light intensity values entails: incrementally adjusting the first lighting element operation to meet the second light intensity value over the predetermined time period and incrementally adjusting second lighting element operation to meet the third light intensity value over a second predetermined time period.

Figure 3:
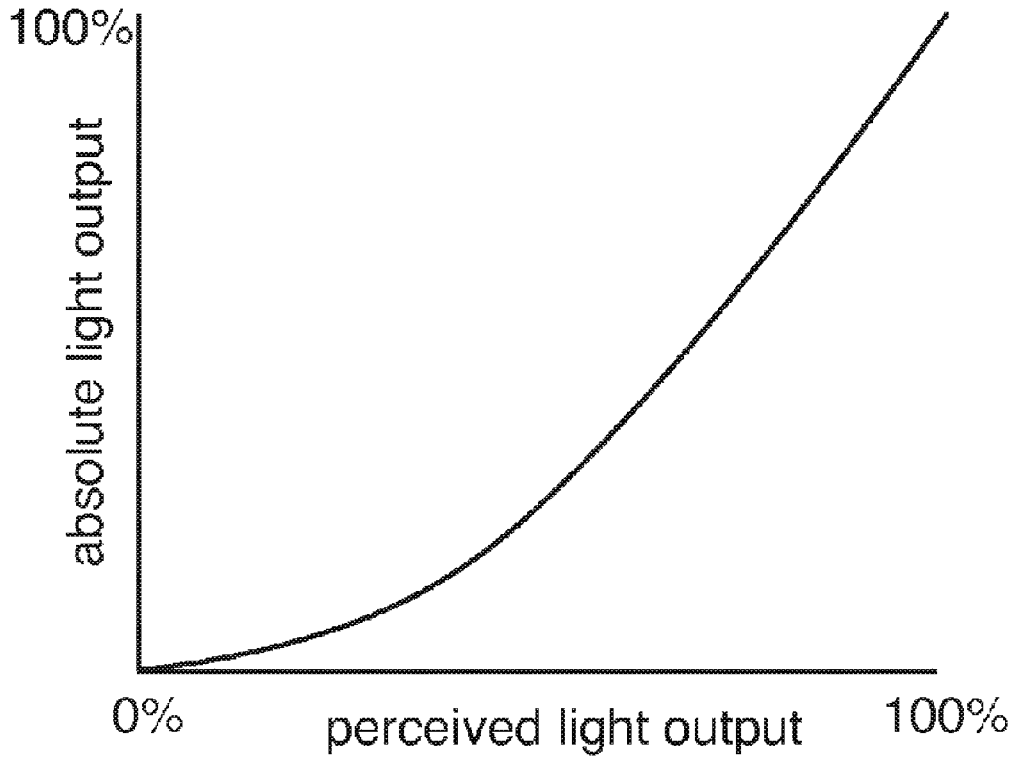
FIG. 3 is a chart showing the correlation of absolute light output to perceived light output by a user according to embodiments of the disclosed technology.

FIG. 3 is a chart showing the correlation of absolute light output to perceived light output by a user according to embodiments of the disclosed technology. The lighting element may be initially set according to the first lighting element control instruction, and lighting element operation may be incrementally adjusted according to the chart in FIG. 3 to meet the second light parameter value over a second predetermined time period.

Figure 4:
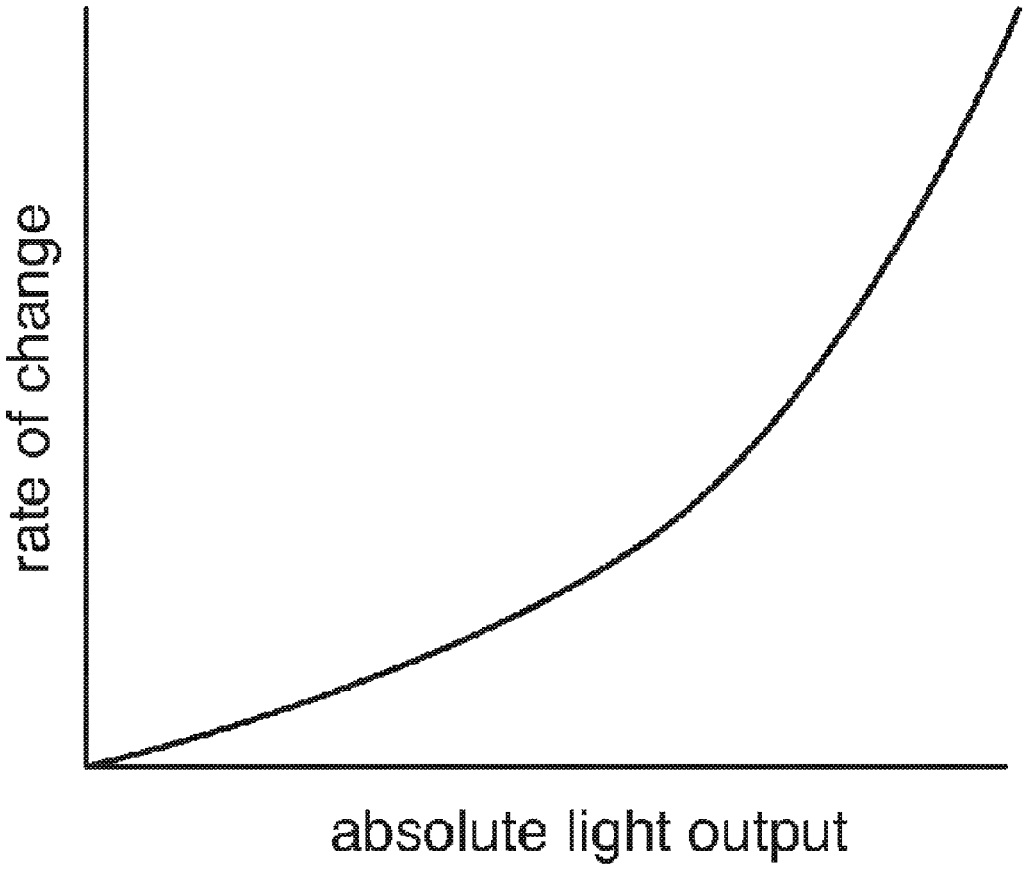
FIG. 4 is a chart showing the correlation of rate of change to absolute light output according to embodiments of the disclosed technology.

FIG. 4 is a chart showing the correlation of rate of change to absolute light output according to embodiments of the disclosed technology.

Figure 5:
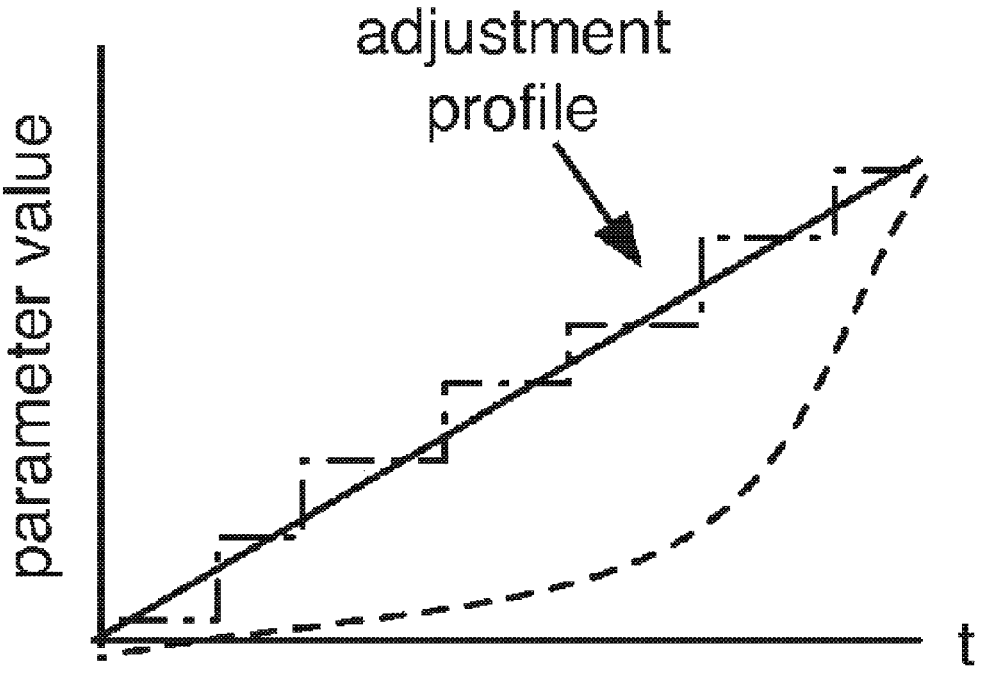
FIG. 5 is a chart showing a parameter value as a function of time based on an adjustment profile according to embodiments of the disclosed technology.

FIG. 5 is a chart showing a parameter value as a function of time based on an adjustment profile according to embodiments of the disclosed technology.

Additional processes may be carried out by: a) determining a plurality of adjustment times the lighting element is initially set; b) determining an intermediary light intensity value for each adjustment time, wherein each intermediary light intensity value is between the first and second light intensity values; determining an intermediary lighting element control instruction for each intermediary light intensity value; and c) at each adjustment time, controlling the lighting element according to the respective lighting element control instruction, and wherein the first lighting element control instruction employs a first current magnitude corresponding to the first light intensity value, and the intermediary lighting element control instruction employs an intermediary current magnitude, different from the first current magnitude, corresponding to the intermediary light intensity value. The first light intensity value corresponds to a first perceived light output value. Determination of the second light intensity value based on the first light intensity value may be carried out by determining a second perceived light output value based on the first perceived light output value and selecting a light intensity value corresponding to the second perceived light output value as the second light intensity value, based on a user perception profile relating light intensity values with perceived light output values.

In still another embodiment of the disclosed technology, a method is provided for semi-automatic lighting system control. The method may be carried out, not necessarily in the following order, by: a) receiving a first light parameter value selection from a user account associated with the lighting system; b) controlling lighting elements of the lighting system to meet the first light parameter value; c) semi-automatically determining a second light parameter value based on the first light parameter value and a user perception profile relating light parameter values with perceived light output values; and d) incrementally adjusting lighting element operation to meet the second light parameter value over a predetermined time period.

The user perception profile may be operable to relate luminous flux with perceived luminous flux. The first light parameter value may have a first luminous flux value, and controlling the lighting elements to meet the first light parameter value may involve controlling the lighting elements to meet the first luminous flux value. The first luminous flux value corresponds to a first perceived luminous flux value, and determining the second light parameter value based on the first light parameter value may involve determining a second perceived luminous flux value based on the first perceived luminous flux value and selecting a second luminous flux value corresponding to the second perceived luminous flux value as the second light parameter value.

One or more additional steps may be carried out, not necessarily in the following order, by: a) determining a lighting system mode based on an identifier for the lighting system, wherein the second light parameter value is determined based on the lighting system mode, further wherein the lighting system mode employs a power reduction mode, wherein the first light parameter value has a first luminous flux value and the second light parameter value has a second luminous flux value lower than the first luminous flux value. b) controlling lighting elements to meet the first light intensity value by determining a current magnitude based on the first light parameter value; and c) supplying current at the current magnitude to the lighting elements, wherein lighting element operation is incrementally adjusted to meet the second light parameter value by incrementally lowering the magnitude of the current supplied to the lighting elements, the first parameter value having a first wavelength.

Figure 6:
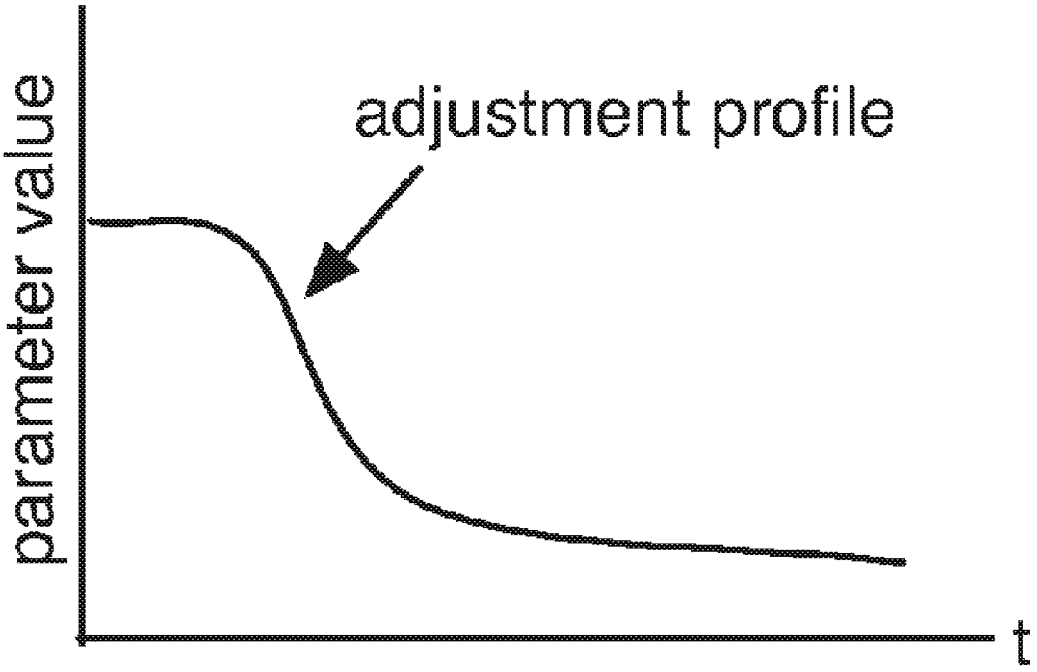
FIG. 6 is a chart showing a parameter value as a function of time based on another adjustment profile according to embodiments of the disclosed technology.
Figure 7:
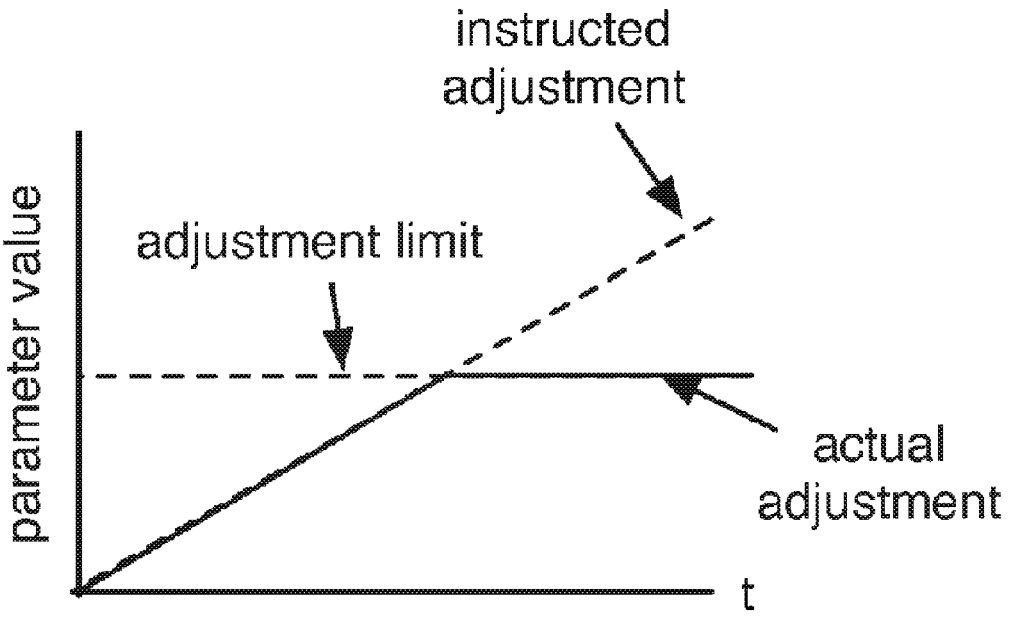
FIG. 7 is a chart showing a parameter value as a function of time with a set adjustment limit according to embodiments of the disclosed technology.

FIG. 6 is a chart showing a parameter value as a function of time based on another adjustment profile according to embodiments of the disclosed technology. FIG. 7 is a chart showing a parameter value as a function of time with a set adjustment limit according to embodiments of the disclosed technology. The user perception profile may employ an equation such as is the case in FIG. 6. While FIG. 7 shows a simple sloped line graph with adjustment limit, FIG. 6 shows a curved value as a function of time. Determining a second light parameter value may involve calculating the second light parameter value as a predetermined percentage of the first light parameter value. The predetermined percentage is selected based on the first light parameter value.

In a further embodiment, the lighting elements are operated to meet the first light parameter value at a first time. Then, lighting element operation is incrementally adjusted to meet the second light parameter value over a predetermined time period by: a) determining a second time separated by the predetermined time period from the first time; b) determining a plurality of adjustment times between the first time and the second time; c) determining a plurality of intermediary light parameter values between the first light parameter value and the second light parameter value, each intermediary light parameter value associated with an adjustment time; and d) in response to occurrence of an adjustment time, controlling the lighting element to meet the respective intermediary light parameter value.

All the pertinent claims, description, and drawings of this application may describe one or more of the instant technologies in operational/functional language, for example as a set of operations to be performed by a computer, CPU, and/or processor. Such operational/functional description in most instances would be understood by one skilled the art as specifically-configured hardware (e.g., because a general purpose computer in effect becomes a special purpose computer once it is programmed to perform particular functions pursuant to instructions from program software).

Importantly, although the operational/functional descriptions described herein are understandable by the human mind, they are not abstract ideas of the operations/functions divorced from computational implementation of those operations/functions. Rather, the operations/functions represent a specification for the massively complex computational machines or other means. As discussed in detail above, the operational/functional language must be read in its proper technological context, i.e., as concrete specifications for physical implementations.

The logical operations/functions described herein are a distillation of machine specifications or other physical mechanisms specified by the operations/functions such that the otherwise inscrutable machine specifications may be comprehensible to the human mind. The distillation also allows one of skill in the art to adapt the operational/functional description of the technology across many different specific vendors' hardware configurations or platforms, without being limited to specific vendors' hardware configurations or platforms.

Some of the present technical description (e.g., detailed description, drawings, claims, etc.) may be set forth in terms of logical operations/functions. As described in more detail in the following paragraphs, these logical operations/functions are not representations of abstract ideas, but rather representative of static or sequenced specifications of various hardware elements. Differently stated, unless context dictates otherwise, the logical operations/functions will be understood by those of skill in the art to be representative of static or sequenced specifications of various hardware elements. This is true because tools available to one of skill in the art to implement technical disclosures set forth in operational/functional formats—tools in the form of a high-level programming language (e.g., C, java, visual basic), etc.)—are generators of static or sequenced specifications of various hardware configurations. This fact is sometimes obscured by the broad term "software," but, as shown by the following explanation, those skilled in the art understand that what is termed "software" is a shorthand for a massively complex interchaining/specification of ordered-matter elements. The term "ordered-matter elements" may refer to physical components of computation, such as assemblies of electronic logic gates, molecular computing logic constituents, quantum computing mechanisms, etc.

For example, a high-level programming language is a programming language with strong abstraction, e.g., multiple levels of abstraction, from the details of the sequential organizations, states, inputs, outputs, etc., of the machines that a high-level programming language actually specifies. See, e.g., VVikipedia, High-level programming language, http://en.wikipedia.org/wiki/High-levelprogramming_language (as of Nov. 11, 2015, 22:00 ET). In order to facilitate human comprehension, in many instances, high-level programming languages resemble or even share symbols with natural languages. See, e.g., Wikipedia, Natural language, http://en.wikipedia.org/wiki/Natural_language (as of Nov. 11, 2015, 22:00 ET).

It has been argued that because high-level programming languages use strong abstraction (e.g., that they may resemble or share symbols with natural languages), they are therefore a "purely mental construct." (e.g., that "software"—a computer program or computer programming—is somehow an ineffable mental construct, because at a high level of abstraction, it can be conceived and understood in the human mind). This argument has been used to characterize technical description in the form of functions/operations as somehow "abstract ideas." In fact, in technological arts (e.g., the information and communication technologies) this is not true.

The fact that high-level programming languages use strong abstraction to facilitate human understanding should not be taken as an indication that what is expressed is an abstract idea. In fact, those skilled in the art understand that just the opposite is true. If a high-level programming language is the tool used to implement a technical disclosure in the form of functions/operations, those skilled in the art will recognize that, far from being abstract, imprecise, "fuzzy," or "mental" in any significant semantic sense, such a tool is instead a near incomprehensibly precise sequential specification of specific computational machines—the parts of which are built up by activating/selecting such parts from typically more general computational machines over time (e.g., clocked time). This fact is sometimes obscured by the superficial similarities between high-level programming languages and natural languages. These superficial similarities also may cause a glossing over of the fact that high-level programming language implementations ultimately perform valuable work by creating/controlling many different computational machines.

The many different computational machines that a high-level programming language specifies are almost unimaginably complex. At base, the hardware used in the computational machines typically consists of some type of ordered matter (e.g., traditional electronic devices (e.g., transistors), deoxyribonucleic acid (DNA), quantum devices, mechanical switches, optics, fluidics, pneumatics, optical devices (e.g., optical interference devices), molecules, etc.) that are arranged to form logic gates. Logic gates are typically physical devices that may be electrically, mechanically, chemically, or otherwise driven to change physical state in order to create a physical reality of Boolean logic.

Logic gates may be arranged to form logic circuits, which are typically physical devices that may be electrically, mechanically, chemically, or otherwise driven to create a physical reality of certain logical functions. Types of logic circuits include such devices as multiplexers, registers, arithmetic logic units (ALUs), computer memory, etc., each type of which may be combined to form yet other types of physical devices, such as a central processing unit (CPU)—the best known of which is the microprocessor.

The Instruction Set Architecture includes a specification of the machine language that can be used by programmers to use/control the microprocessor. Since the machine language instructions are such that they may be executed directly by the microprocessor, typically they consist of strings of binary digits, or bits. For example, a typical machine language instruction might be many bits long (e.g., 32, 64, or 128 bit strings are currently common).

It is significant here that, although the machine language instructions are written as sequences of binary digits, in actuality those binary digits specify physical reality. For example, if certain semiconductors are used to make the operations of Boolean logic a physical reality, the apparently mathematical bits "1" and "0" in a machine language instruction actually constitute a shorthand that specifies the application of specific voltages to specific wires. For example, in some semiconductor technologies, the binary number "1" (e.g., logical "1") in a machine language instruction specifies around +5 volts applied to a specific "wire" (e.g., metallic traces on a printed circuit board) and the binary number "0" (e.g., logical "0") in a machine language instruction specifies around −5 volts applied to a specific "wire." In addition to specifying voltages of the machines' configuration, such machine language instructions also select out and activate specific groupings of logic gates from the millions of logic gates of the more general machine. Thus, far from abstract mathematical expressions, machine language instruction programs, even though written as a string of zeros and ones, specify many, many constructed physical machines or physical machine states.

Machine language is typically incomprehensible by most humans (e.g., the above example was just ONE instruction, and some personal computers execute more than two billion instructions every second).

Thus, programs written in machine language—which may be tens of millions of machine language instructions long—are incomprehensible. In view of this, early assembly languages were developed that used mnemonic codes to refer to machine language instructions, rather than using the machine language instructions' numeric values directly (e.g., for performing a multiplication operation, programmers coded the abbreviation "mult," which represents the binary number "011000" in MIPS machine code). While assembly languages were initially a great aid to humans controlling the microprocessors to perform work, in time the complexity of the work that needed to be done by the humans outstripped the ability of humans to control the microprocessors using merely assembly languages.

At this point, it was noted that the same tasks needed to be done over and over, and the machine language necessary to do those repetitive tasks was the same. In view of this, compilers were created. A compiler is a device that takes a statement that is more comprehensible to a human than either machine or assembly language, such as "add 2+2 and output the result," and translates that human understandable statement into a complicated, tedious, and immense machine language code (e.g., millions of 32, 64, or 128 bit length strings). Compilers thus translate high-level programming language into machine language.

This compiled machine language, as described above, is then used as the technical specification which sequentially constructs and causes the interoperation of many different computational machines such that humanly useful, tangible, and concrete work is done. For example, as indicated above, such machine language—the compiled version of the higher-level language—functions as a technical specification which selects out hardware logic gates, specifies voltage levels, voltage transition timings, etc., such that the humanly useful work is accomplished by the hardware.

Thus, a functional/operational technical description, when viewed by one of skill in the art, is far from an abstract idea. Rather, such a functional/operational technical description, when understood through the tools available in the art such as those just described, is instead understood to be a humanly understandable representation of a hardware specification, the complexity and specificity of which far exceeds the comprehension of most any one human. With this in mind, those skilled in the art will understand that any such operational/functional technical descriptions—in view of the disclosures herein and the knowledge of those skilled in the art—may be understood as operations made into physical reality by (a) one or more interchained physical machines, (b) interchained logic gates configured to create one or more physical machine(s) representative of sequential/combinatorial logic(s), (c) interchained ordered matter making up logic gates (e.g., interchained electronic devices (e.g., transistors), DNA, quantum devices, mechanical switches, optics, fluidics, pneumatics, molecules, etc.) that create physical reality representative of logic(s), or (d) virtually any combination of the foregoing. Indeed, any physical object which has a stable, measurable, and changeable state may be used to construct a machine based on the above technical description. Charles Babbage, for example, constructed the first computer out of wood and powered by cranking a handle.

Thus, far from being understood as an abstract idea, those skilled in the art will recognize a functional/operational technical description as a humanly-understandable representation of one or more almost unimaginably complex and time sequenced hardware instantiations. The fact that functional/operational technical descriptions might lend themselves readily to high-level computing languages (or high-level block diagrams for that matter) that share some words, structures, phrases, etc. with natural language simply cannot be taken as an indication that such functional/operational technical descriptions are abstract ideas, or mere expressions of abstract ideas. In fact, as outlined herein, in the technological arts this is simply not true. When viewed through the tools available to those of skill in the art, such functional/operational technical descriptions are seen as specifying hardware configurations of almost unimaginable complexity.

As outlined above, the reason for the use of functional/operational technical descriptions is at least twofold. First, the use of functional/operational technical descriptions allows near-infinitely complex machines and machine operations arising from interchained hardware elements to be described in a manner that the human mind can process (e.g., by mimicking natural language and logical narrative flow). Second, the use of functional/operational technical descriptions assists the person of skill in the art in understanding the described subject matter by providing a description that is more or less independent of any specific vendors piece(s) of hardware.

The use of functional/operational technical descriptions assists the person of skill in the art in understanding the described subject matter since, as is evident from the above discussion, one could easily, although not quickly, transcribe the technical descriptions set forth in this document as trillions of ones and zeroes, billions of single lines of assembly-level machine code, millions of logic gates, thousands of gate arrays, or any number of intermediate levels of abstractions. However, if any such low-level technical descriptions were to replace the present technical description, a person of skill in the art could encounter undue difficulty in implementing the disclosure, because such a low-level technical description would likely add complexity without a corresponding benefit (e.g., by describing the subject matter utilizing the conventions of one or more vendor-specific pieces of hardware). Thus, the use of functional/operational technical descriptions assists those of skill in the art by separating the technical descriptions from the conventions of any vendor-specific piece of hardware.

In view of the foregoing, the logical operations/functions set forth in the present technical description are representative of static or sequenced specifications of various ordered-matter elements, in order that such specifications may be comprehensible to the human mind and adaptable to create many various hardware configurations. The logical operations/functions disclosed herein should be treated as such, and should not be disparagingly characterized as abstract ideas merely because the specifications they represent are presented in a manner that one of skill in the art can readily understand apply in a manner independent of a specific vendor's hardware implementation.

While the disclosed technology has been taught with specific reference to the above embodiments, a person having ordinary skill in the art will recognize that changes can be made in form and detail without departing from the spirit and the scope of the disclosed technology. The described embodiments are to be considered in all respects only as illustrative and not restrictive. All changes that come within the meaning and range of equivalency of the specification and any future claims are to be embraced within their scope. Combinations of any of the methods, systems, and devices described hereinabove are also contemplated and within the scope of the invention. Accordingly, the foregoing description should not be read as pertaining only to the precise structures described and shown in the accompanying drawings, but rather should be read as consistent with and as support for any claims which may be appended to any application claiming priority to the present application, which are to have their fullest and fairest scope.

Although exemplary systems and methods are described in language specific to structural features and/or methodological acts, the subject matter defined in the future claims is not necessarily limited to the specific features or acts described. Rather, the specific features and acts are disclosed as exemplary forms of implementing the claimed systems, methods, and structures.

Moreover, means-plus-function clauses in the future claims cover the structures described herein as performing the recited function and not only structural equivalents but also equivalent structures. Thus, a nail and a screw may not be structural equivalents because a nail employs a cylindrical surface to secure parts together and a screw employs a helical surface, but in the environment of fastening parts, a nail may be the equivalent structure to a screw. Applicant expressly intends to not invoke 35 U.S.C. §112, paragraph 6, for any of the limitations of the claims herein except for claims which explicitly use the words "means for" with a function.

What is claimed:

1. A method for semi-automatic lighting system control used within an area, the lighting system having a lighting element, the method comprising:

receiving a first light intensity value from a user account associated with an identifier for the lighting system;

determining a first lighting element control instruction based on the first light intensity value;

controlling the lighting element according to the first lighting element control instruction;

determining lighting system association in light of amount of traffic within the area;

within a predetermined time period from first light intensity value receipt, semi-automatically determining second light intensity value based on the lighting system mode and first light intensity value, the second light intensity value being lower than the first light intensity value;

incrementally adjusting lighting element operation to meet the second light parameter value over a second predetermined time period; and using a second user perception profile as an additional user perception profile to account for an optimized balance between preferences of all users semi-automatically, further therein the determination is based on location of all the users and number of the visitors within the area.

2. The method of claim 1, wherein the second light intensity value is selected based on a user perception profile, wherein the user perception profile relates light intensity values with perceived light output values, and further wherein the user perception profile is for the user account.

3. The method of claim 1, further comprising:

receiving a third light intensity value from the user account, wherein the third light intensity value is between the first and second light intensity values;

determining a third lighting element control instruction based on the third light intensity value;

controlling the lighting element according to the third lighting element control instruction; and updating the user perception profile based on the third light intensity value.

4. The method of claim 3, wherein:

the lighting element operation is incrementally adjusted in response to determination that a user device associated with the user account is located within a predetermined physical region, further wherein the second light parameter value comprises a second light intensity value.

5. The method of claim 4, further comprising:

determining second user device location within the predetermined physical region, the second user device associated with a second user account;

semi-automatically determining a third light intensity value based on the first light intensity value and a second user perception profile associated with the second user account; and operating the lighting system based on the second and third light intensity values, wherein the lighting system further employs a second lighting element, the first and second lighting elements mounted at a first and second radial position on the lighting system, wherein operating the lighting system based on the second and third light intensity values entails: incrementally adjusting the first lighting element operation to meet the second light intensity value over the predetermined time period and incrementally adjusting second lighting element operation to meet the third light intensity value over a second predetermined time period.

6. The method of claim 1, wherein the lighting element is initially set according to the first lighting element control instruction, and lighting element operation is incrementally adjusted to meet the second light parameter value over a second predetermined time period.

7. The method of claim 6, further comprising:

determining a plurality of adjustment times the lighting element is initially set;

determining an intermediary light intensity value for each adjustment time, wherein each intermediary light intensity value is between the first and second light intensity values; determining an intermediary lighting element control instruction for each intermediary light intensity value; and at each adjustment time, controlling the lighting element according to the respective lighting element control instruction, and wherein the first lighting element control instruction employs a first current magnitude corresponding to the first light intensity value, and the intermediary lighting element control instruction employs a intermediary current magnitude, different from the first current magnitude, corresponding to the intermediary light intensity value.

8. The method of claim 1, wherein the first light intensity value corresponds to a first perceived light output value, further wherein determining the second light intensity value based on the first light intensity value is carried out by determining a second perceived light output value based on the first perceived light output value and selecting a light intensity value corresponding to the second perceived light output value as the second light intensity value, based on a user perception profile relating light intensity values with perceived light output values.

* * * * *